US007758047B2

(12) United States Patent
Colas

(10) Patent No.: US 7,758,047 B2
(45) Date of Patent: Jul. 20, 2010

(54) WORD GAME USING STYLIZED LETTERS THAT SHARE AT LEAST ONE COMMON SIDE

(76) Inventor: Sean J. Colas, 147 Logan Xing, Davidson, NC (US) 28036-7792

( * ) Notice: Subject to any disclaimer, the term of this patent is extended or adjusted under 35 U.S.C. 154(b) by 95 days.

(21) Appl. No.: 12/050,276

(22) Filed: Mar. 18, 2008

(65) Prior Publication Data

US 2009/0236802 A1 Sep. 24, 2009

(51) Int. Cl.
*A63F 3/00* (2006.01)

(52) U.S. Cl. ..... 273/272; 273/429

(58) Field of Classification Search ..... 273/272, 273/299, 429–432

See application file for complete search history.

(56) References Cited

U.S. PATENT DOCUMENTS

| | | | | |
|---|---|---|---|---|
| 4,014,548 | A | 3/1977 | Trilling | |
| 4,341,389 | A | 7/1982 | Dumont | |
| 5,195,753 | A * | 3/1993 | Brukl et al. | 273/429 |
| 5,280,914 | A * | 1/1994 | Selby et al. | 273/287 |
| 5,308,077 | A * | 5/1994 | Caggiano | 273/243 |
| 5,645,280 | A * | 7/1997 | Zelmer | 273/256 |
| 5,788,238 | A * | 8/1998 | LeBriton et al. | 273/272 |
| 5,813,672 | A * | 9/1998 | Loud, Jr. | 273/272 |
| 5,899,456 | A * | 5/1999 | Weinstock et al. | 273/243 |
| 6,019,372 | A * | 2/2000 | Polaski et al. | 273/272 |
| 6,267,376 | B1 * | 7/2001 | Jenkins | 273/258 |
| 6,431,545 | B1 * | 8/2002 | Kuhne | 273/272 |
| 6,634,644 | B2 * | 10/2003 | Falana | 273/272 |
| 7,100,920 | B2 | 9/2006 | Onstad et al. | |
| 7,267,340 | B2 | 9/2007 | Hyra et al. | |
| 2004/0188941 | A1 * | 9/2004 | Levin | 273/299 |
| 2006/0261554 | A1 * | 11/2006 | Hamner | 273/272 |
| 2007/0246888 | A1 * | 10/2007 | Seal | 273/430 |
| 2007/0273101 | A1 * | 11/2007 | Berke et al. | 273/430 |
| 2008/0216022 | A1 * | 9/2008 | Lorch et al. | 715/847 |
| 2008/0246217 | A1 * | 10/2008 | Myers et al. | 273/292 |

FOREIGN PATENT DOCUMENTS

WO 02/20103 A1 3/2002

* cited by examiner

*Primary Examiner*—William M Pierce
(74) *Attorney, Agent, or Firm*—Adams Intellectual Property Law

(57) ABSTRACT

A word game in which a participant attempts to decipher a word formed from a plurality of stylized alphabet letters that share a common side. The alphabet letters are majuscule English language alphabet letters in a block style font formed of line segments on a square grid. A portion of the alphabet letters is assigned a first level of difficulty, another portion is assigned a second level of difficulty different than the first level of difficulty, and yet another portion may be assigned a third level of difficulty different than the first and the second levels of difficulty. A word score is determined by adding together the level of difficulty assigned to each of the alphabet letters. A word formed from the alphabet letters may be assigned a level of difficulty determined by the word score of the word and the number of letters in the word.

18 Claims, 6 Drawing Sheets

WORD GAME USING STYLIZED LETTERS THAT SHARE AT LEAST ONE COMMON SIDE

FIELD OF THE INVENTION

The present invention relates generally to puzzles and games for entertainment purposes. More particularly, the invention relates to a word game wherein a participant attempts to decipher a word formed from two or more stylized alphabet letters that share at least one common side.

BACKGROUND OF THE INVENTION

Crossword puzzles and word games are universally enjoyed by people of various ages for entertainment purposes. As a result, countless numbers of crossword puzzles and word games have been developed over the years. The objective of most crossword type puzzles is to complete a pattern or grid with alphabet letters to form words that correspond to one or more clues. The objective of many word games is to form a word on a playing surface from alphabet letters provided to a participant. The alphabet letters are provided to the participant, for example, by rolling one or more playing die having alphabet letters printed thereon or by selecting playing pieces from a plurality of tiles imprinted with alphabet letters. Typically, the letters are given different point values so that a "Word Score" may be determined and awarded to a participant based on the difficulty of the letters and the number of letters used to form the word. Regardless, an objective common to both crossword puzzles and word games is for a participant to form words from ordinary alphabet letters. While crossword puzzles and word games having the objective of forming words from alphabet letters are quite common, there are very few puzzles or word games that require a participant to identify words formed from alphabet letters.

A word-forming game that also requires a participant to identify the word from only a portion of the word is disclosed in U.S. Pat. No. 7,267,340 B2 issued Sep. 11, 2007, to Hyra et al. and assigned to The Upper Deck Company of North Las Vegas, Nev. Hyra et al. disclose an interactive word-forming game wherein a first participant obtains a plurality of game pieces (tiles) having word-forming indicia (one or more ordinary alphabet letters) printed thereon. The first participant positions one of the game pieces on a pre-designated position of a game board to partially form a word. A second participant then chooses between two options: (1) attempting to identify the word; and (2) asserting that no word can be formed from the game piece. If the second participant chooses the first option, the first participant either (a) admits that the second participant correctly identified the word; or (b) positions a second game piece on the game board adjacent the first game piece to partially or completely form the same word, or a different word. If the second participant chooses the second option, the first participant either (a) admits that no word can be formed form the first game piece; or (b) positions one or more other game pieces on the game board adjacent the first game piece to completely form the word.

Hyra et al. teach a word game that involves both forming a portion of a word from a plurality of alphabet letters and identifying the word from the portion of the word positioned on the game board. It would seemingly be a trivial task, however, for the second player to identify the word if the alphabet letters placed on the game board revealed the entire word instead of only a portion of the word. Although not immediately obvious, the task could be made more difficult if the alphabet letters partially or completely forming the word were positioned on the game board in random order (i.e. scrambled). In this manner, the level of difficulty of the game could be adjusted to appeal to participants having a broader range of skill levels. A Word Score could then be awarded to the participant attempting to identify the word based on the difficulty of the letters and/or the number of letters used to form the word, as well as whether the letters were scrambled or not. Unfortunately, as yet there is no known crossword puzzle or word game that requires a participant to identify a word formed from ordinary alphabet letters wherein the level of difficulty of the word can be varied to accommodate participants having a broad range of skill levels.

Accordingly, it is apparent a need exists for a word game that requires a participant to identify or decipher a word formed from a plurality of alphabet letters. A further need exists for such a word game wherein the level of difficulty of the word to be deciphered can be varied to accommodate a broad range of skill levels. A specific need exists for a word game that utilizes stylized alphabet letters to form a word that is not readily identifiable, thereby increasing the level of skill required of a participant to decipher the word.

BRIEF DESCRIPTION OF THE DRAWINGS

A word game according to the present invention wherein a participant attempts to decipher a word formed from stylized alphabet letters sharing at least one common side is best understood by reference to the following detailed description taken in conjunction with the accompanying drawing figures in which.

DETAILED DESCRIPTION OF THE INVENTION

Figure 1:
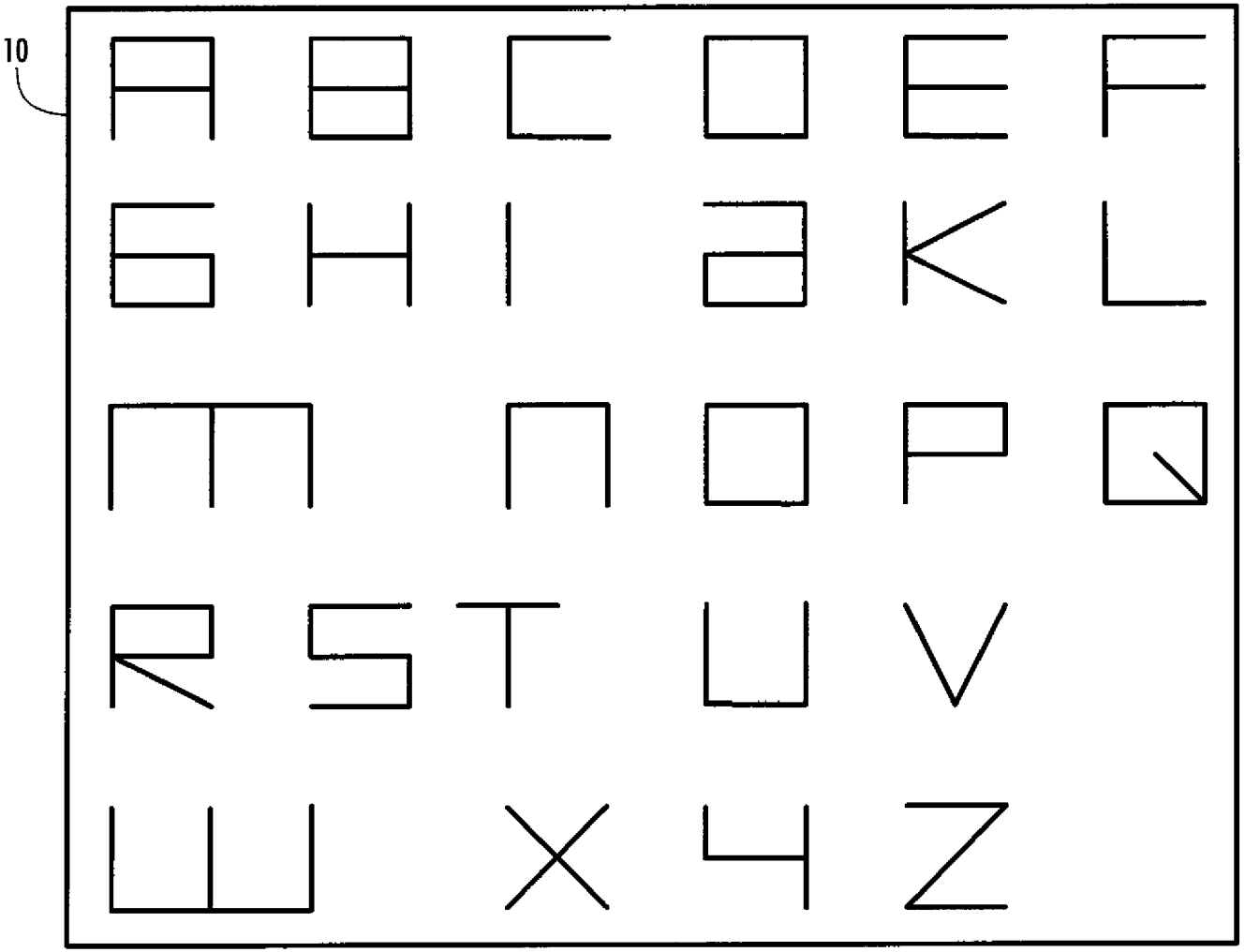
FIG. 1 depicts an exemplary embodiment of a chart of stylized alphabet letters for forming words from two or more of the stylized letters that share at least one common side.

Referring to the accompanying drawing figures wherein identical reference numerals denote the same elements throughout the various views, a word game according to the present invention is depicted in the drawing figures and described in greater detail below. As used herein, the term "word game" is intended to be construed broadly to include word puzzles, for example conventional crossword puzzles and hidden-word puzzles, as well as word games using stylized alphabet letters that share at least one common side. A common objective of all such word games is to decipher one or more words formed from the stylized letters. Beyond this common objective, a word game according to the invention may incorporate other objectives and may include any rules a game developer or participant desires. A word game configured in accordance with the present invention is generally referred to as a "Word Merge" game since the stylized alphabet letters used in the game share at least one common side, thereby giving the illusion of a word formed from letters "merged" together. Exemplary embodiments of word games configured in accordance with the invention are provided herein in order to clearly define the invention and thereby enable one of ordinary skill in the art to make, use and practice the invention. However, the invention is not intended to be limited by the exemplary embodiments in any manner. Instead, the appended claims should be construed as broadly as possible consistent with this written description.

FIG. 1 depicts a chart of a plurality of stylized alphabet letters, indicated generally at 10, suitable for use with the present invention. The stylized alphabet letters 10, also referred to herein as "Word Merge Letters," are majuscule (i.e. upper case or capital) English language alphabet letters in a block style font that have been formed on a square grid using line segments. It should be noted that the Word Merge Letter I consists of a single vertical line segment that is aligned along the left-hand side of the square grid. Similarly, the vertical line segment of the Word Merge Letter T is aligned along the left-hand side of the square grid such that the left-hand portion of the horizontal line segment at the top extends outside the square grid. The purpose for aligning the Word Merge Letters I and T on the square grid in this manner will become apparent when words such as FISH and TURTLE (shown in FIG. 4) are formed from the Word Merge Letters, as will be described. In general, the I and T are aligned in this manner in order to further obscure the letters and thereby increase the difficulty of deciphering a word formed from the Word Merge Letters. It should also be noted that the Word Merge Letters M and W are twice as wide as the other letters, and therefore, conform to a rectangular grid instead of a square grid. However, the Word Merge Letter M consists of two side-by-side Word Merge Letters N, and the Word Merge Letter W consists of two side-by-side Word Merge Letters U, in order to further obscure the letters within a word including the Word Merge Letters M and/or W.

Figure 4:
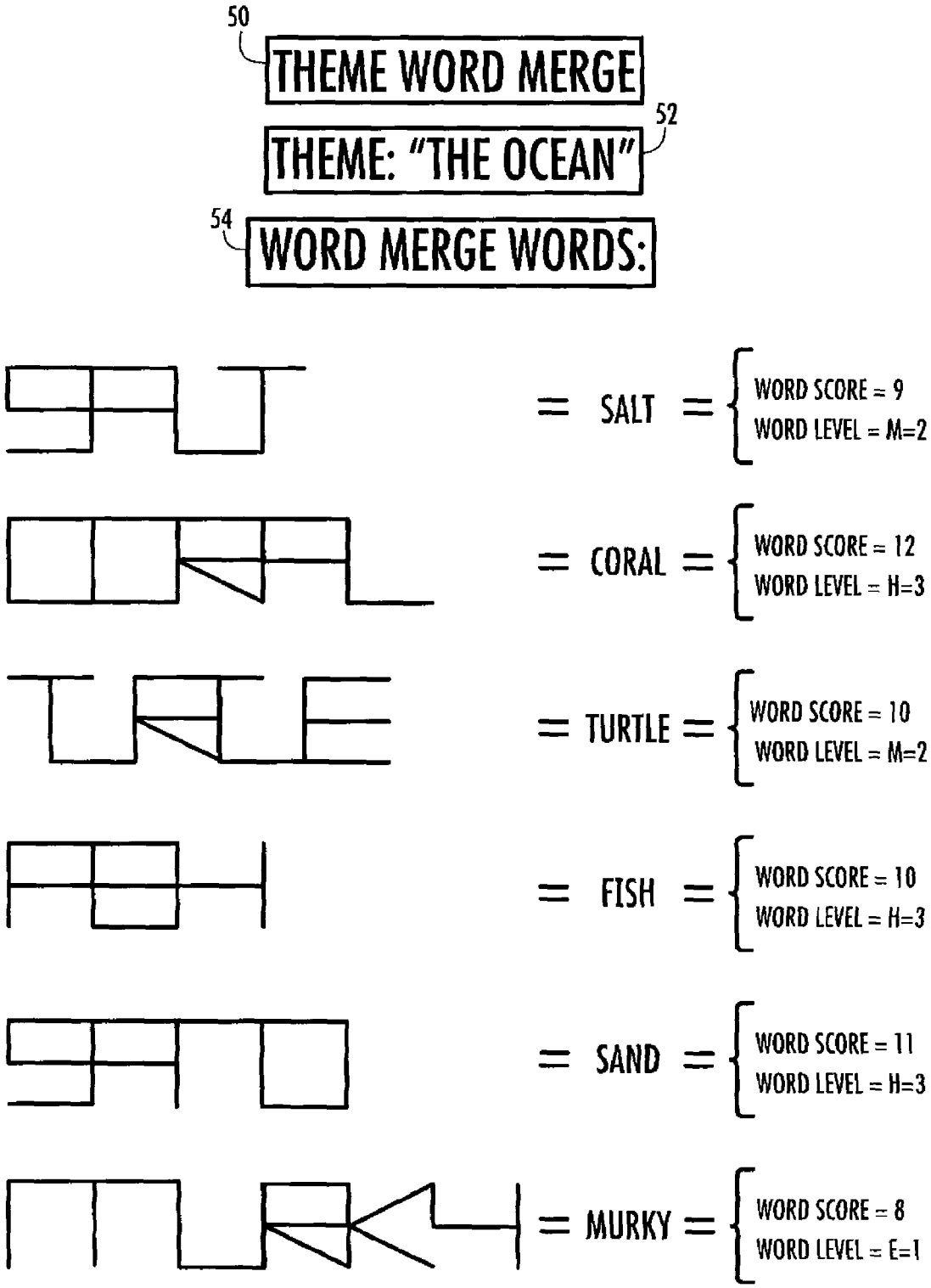
FIG. 4 illustrates a first exemplary embodiment of a word game wherein an objective is to decipher a word formed from the stylized alphabet letters of FIG. 1 that share at least one common side.

Importantly, at least one of the line segments of each Word Merge Letter will be coincident with (i.e. overlap) at least one line segment of another Word Merge Letter when the letters share a common side. For example, when the Word Merge Letters S, A, L and T are merged together to form the word SALT (as shown in FIG. 4), the right-hand vertical line segment of the Word Merge Letter S is coincident with the lower portion of the left-hand vertical line segment of the Word Merge Letter A. Similarly, the right-hand vertical line segment of the Word Merge Letter A is coincident with the vertical line segment on the left-hand side of the Word Merge Letter L. As previously mentioned, the vertical line segment of the Word Merge Letter T is aligned with the left-hand side of its square grid. As a result, left-hand portion of the horizontal line segment of the Word Merge Letter L extends into the square grid of the Word Merge Letter L. In this example, the Word Merge Letter T is not further obscured within the word SALT since it shares a common side with the Word Merge Letter L. However, when the word TURTLE is formed, the Word Merge Letter T is further obscured since the left-hand portion of the horizontal line segment is coincident with a portion of the upper horizontal line segment of the Word Merge Letter R. In another example, the Word Merge Letter I is completely obscured (i.e. hidden) when Word Merge Letters are used to form the word FISH since the vertical line segment of the Word Merge Letter I is coincident with the left-hand vertical line segment of the Word Merge Letter S. As a result, the F can be misinterpreted to be the Word Merge Letter A, while the S can be misinterpreted to be the Word Merge Letter G. The S can be further misinterpreted to be the Word Merge Letter B or the Word Merge Letter E when the left-hand vertical line segment of the Word Merge Letter H is added. In addition, word is more difficult to decipher since it appears to consist of only three letters instead of four. The characteristic of Word Merge Letters sharing a common side may also be referred to as "fused" or "merged," for reasons that will become apparent.

Figure 2:
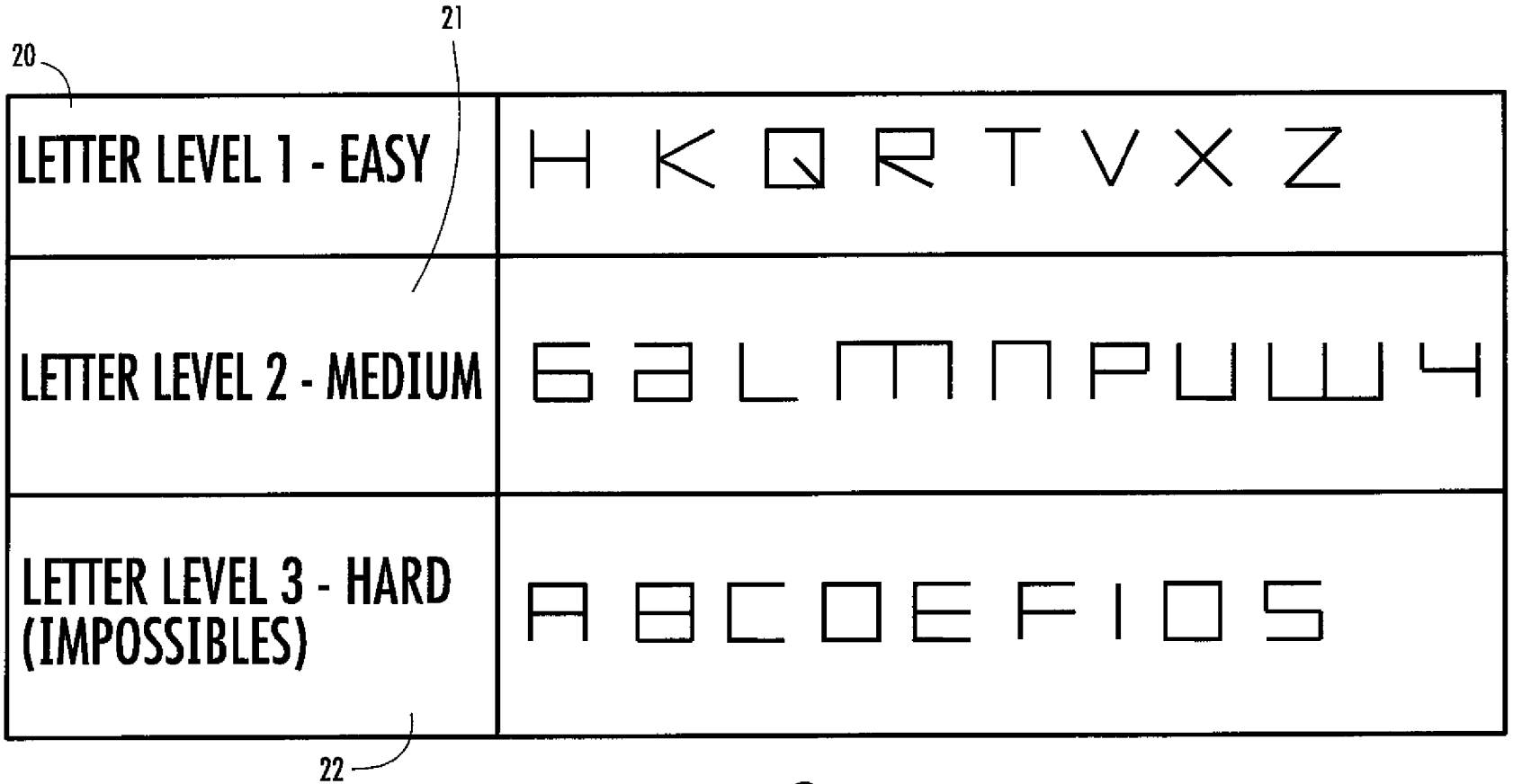
FIG. 2 depicts an exemplary embodiment of a chart for determining a level of difficulty assigned to the stylized alphabet letters of FIG. 1.

FIG. 2 depicts a chart for determining a level of difficulty assigned to the stylized alphabet letters 10 of FIG. 1. The Word Merge Letters are divided into three levels of difficulty 20, 21, 22 corresponding to the degree of difficulty typically required to identify the letter within a word formed from the Word Merge Letters. The three levels of difficulty 20, 21, 22 are referred to herein as Letter Level 1, Letter Level 2 and Letter Level 3. In the particular example shown and described herein, the Letter Level 1 letters correspond to Word Merge Letters that are fairly easy to identify. The Letter Level 2 letters correspond to Word Merge Letters having a medium degree of difficulty to identify, while the Letter Level 3 letters correspond to Word Merge Letters that are relatively hard to identify. In general, Word Merge Letters having an angled line segment fall within Letter Level 1. The Word Merge Letter H is included in Letter Level 1 since it lacks both an upper horizontal line segment and a lower horizontal line segment. The Word Merge Letter T is included in Letter Level 1 since a right-hand portion of the horizontal line segment extends partially into a first square grid and the left-hand portion extends partially into an adjacent second square grid to the left of the first square grid. In general, Word Merge Letters are assigned to Letter Level 2 and Letter Level 3 depending on the degree of difficulty typically required to identify the letter within a word formed from a plurality of Word Merge Letters that share a common side. The Word Merge Letters A, B, C, D, E, F, I, O and S (Letter Level 3) are sometimes referred to as "impossibles" since words formed from those Word Merge Letters are the most difficult to decipher, as will be described.

Figure 3:
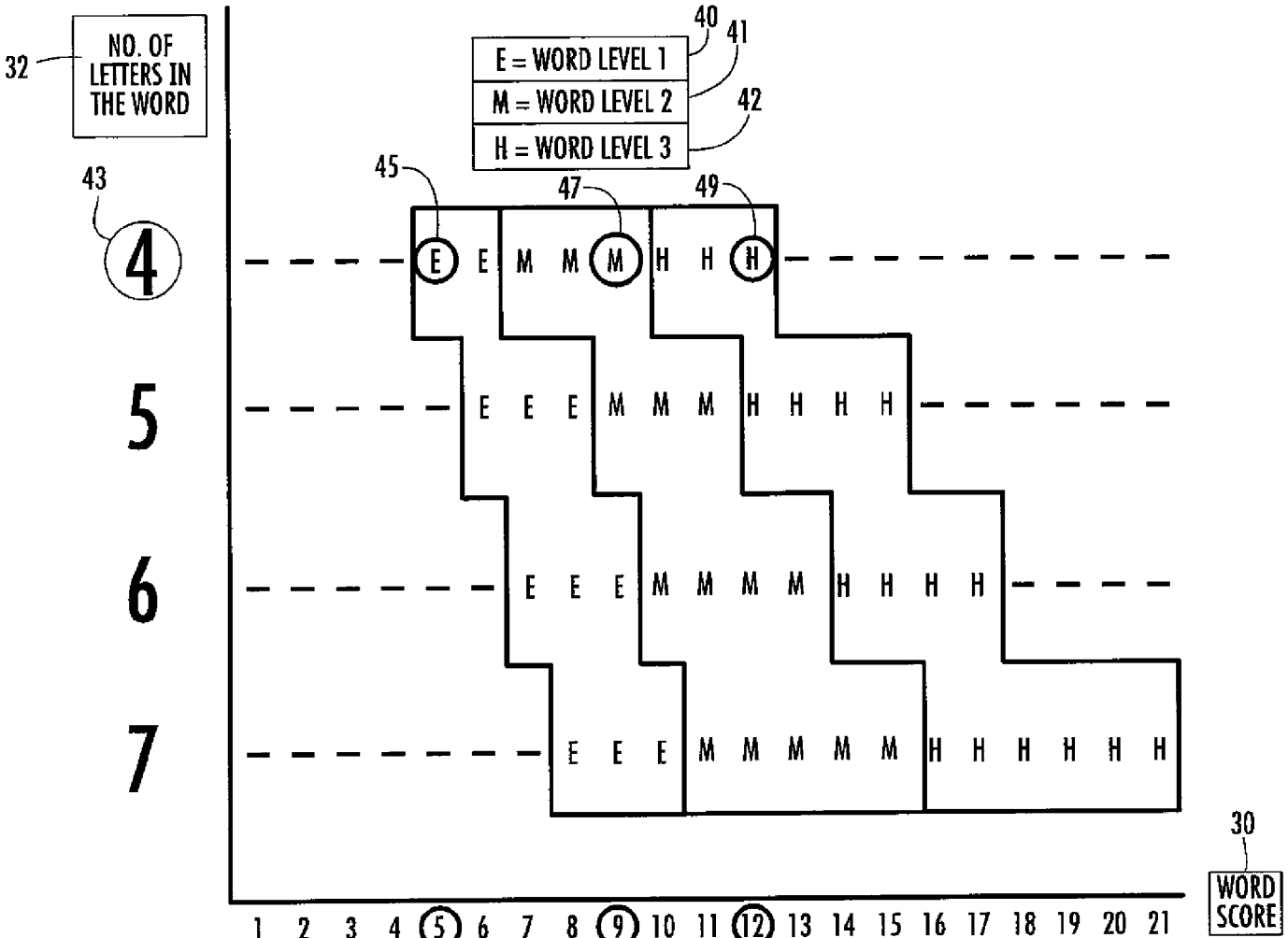
FIG. 3 depicts an exemplary embodiment of a chart for determining level of difficulty of a word formed from the stylized alphabet letters of FIG. 1 based on a Word Score calculated for the word and the number of letters in the word.

FIG. 3 depicts a chart for determining level of difficulty of a word formed from the stylized alphabet letters 10 of FIG. 1 based on a Word Score 30 calculated for the word and the number of letters in the word 32. Words formed from the Word Merge Letters are divided into three levels of difficulty 40, 41, 42 corresponding to the degree of difficulty typically required to decipher the word. The three levels of difficulty 40, 41, 42 are referred to herein as Word Level 1, Word Level 2 and Word Level 3. In the particular example shown and described herein, the chart indicates word levels for words formed from four, five, six and seven Word Merge Letters. The Word Score 30 for a word formed from the Word Merge Letters is calculated by adding together the Letter Level (1, 2 or 3) of each of the Word Merge Letters. For example, the word HURT contains the Word Merge Letters H having a Letter Level 1; U having a Letter Level 2; R having a Letter Level 1; and T having a Letter Level 1. Accordingly, the Word Score 30 for the word HURT is 1+2+1+1=5. Since in this example the number of letters in the word 32 formed form the Word Merge Letters ranges between 4 and 7, the Word Score 30 must range between a minimum of 4 (i.e. a four letter word consisting of only letters having a Letter Level 1) and a maximum of 21 (i.e. a seven letter word consisting of only letters having a Letter Level 3). However, in the example shown and described herein, none of the Word Merge Letters having a Letter Level 1 are vowels. Thus, the theoretical minimum Word Score 30 is one more than the number of letters in the word 32 (e.g. HURT=5 for a four letter word). As a result, the Word Score 30 for four letter words ranges between 5 and 12 and the Word Score 30 for seven letter words ranges between 8 and 21. The chart can be extrapolated in the manner described above to include words having fewer than four letters and/or words having more than seven letters.

The chart depicted in FIG. 3 includes three Word Levels for each row corresponding to the number of letters used in the word 32. Word Level 1 words, indicated by E in the chart, correspond to words that are fairly easy to decipher. Word Level 2 words, indicated by M in the chart, correspond to words having a medium level of difficulty to decipher, while Word Level 3 words, indicated by H in the chart, correspond to words that are relatively hard to decipher. The Word Level for a particular word formed from a plurality of Word Merge Letters that share a common side is determined by using the chart to cross-reference the Word Score 30 for the word with the number of letters in the word 32. For example, the word HURT formed from the four Word Merge Letters H, U, R, T has a Word Score of 5, as previously described. When the row corresponding to the number of letters in the word equal to 4 (reference numeral 43) is cross-referenced with the column corresponding to a Word Score equal to 5 (reference numeral 44), the chart indicates an E level of difficulty (reference numeral 45), which corresponds to Word Level 1 (reference numeral 40). Similarly, the word SALT formed from the four Word Merge Letters S, A, L, T has a Word Score of 9 (reference numeral 46) and the chart indicates an M level of difficulty (reference numeral 47), which corresponds to Word Level 2 (reference numeral 41). In the same manner, the word BEAD formed from the four Word Merge Letters B, E, A, D has a Word Score of 12 (reference numeral 48) and the chart indicates an H level of difficulty (reference numeral 49), which corresponds to Word Level 3 (reference numeral 42). Word Level 3 words are sometimes referred to as "impossibles" since words formed from Word Merge Letters having those Word Score 30 and number of letters in the word 32 combinations are the most difficult to decipher. As will be described, the Word Level may be utilized to award a score to a participant of a word game using the stylized alphabet letters 10 that share a common side.

As will be readily appreciated, the Word Score 30 and the number of letters in the word 32 formed by the Word Merge Letters are only two factors that can be combined to determine the levels of difficulty 40, 41, 42 typically required to decipher the word. The scope of the present invention is not intended to be limited to these factors, or to any other combination of factors. To the extent that the Letter Level assigned to each Word Merge Letter is not subjective, these factors represent objective factors that may be used to determine the level of difficulty (i.e. Word Level) of words formed from a plurality of Word Merge Letters. However, these factors and the combination thereof are not exclusive and other objective and/or subjective factors may be employed to determine a Word Level. For example, an additional subjective factor may be the position or arrangement of the Word Merge Letters within a word. The Word Merge Letter T is fairly easy to identify when positioned at the beginning or the end of a word, as evidenced by the word SALT shown in FIG. 4. In contrast, the Word Merge Letter T is more difficult to identify when positioned medially within the word and adjacent to a Word Merge Letter including an upper horizontal line segment, such as R or S, as evidenced by the word TURTLE shown in FIG. 4. Accordingly, the developer of a word game, or the participants, may choose to include a subjective factor such as the position or arrangement of the Word Merge Letters within a word to determine the Word Level for that word, and consequently, the score to be awarded a participant for correctly deciphering the word.

FIG. 4 illustrates a first exemplary embodiment of a word game 50 wherein an objective is to decipher a word formed from the stylized alphabet letters 10 of FIG. 1 that share at least one common side. The word game 50 illustrated in FIG. 4 is presently referred to as "Theme Word Merge" and includes a theme 52 and one or more Word Merge Words 54 relating to the theme. As used herein, the term "Word Merge Word" or "Merge Word" refers to a word formed from a plurality of the stylized alphabet letters 10 of FIG. 1 that share at least one common side. In other words, Word Merge Words 54 are words consisting of Word Merge Letters positioned and arranged in the manner described herein to form words to be deciphered by a participant of a word game according to the present invention. It should be noted that in the examples provided herein the Word Merge Letters are arranged horizontally. However, the Word Merge Letters may also be arranged vertically in any suitable manner to form, for example, a conventional crossword type puzzle having horizontal and vertical squares formed by Word Merge Letters.

An objective of the word game 50 illustrated in FIG. 4 is for a participant to decipher the one or more Word Merge Words 54 relating to the theme 52 provided to the participant. In the example shown and described herein, the theme 52 is "The Ocean" and the Word Merge Words 54 to be deciphered are SALT, CORAL, TURTLE, FISH, SAND and MURKY. The Word Score and the Word Level are determined for each Merge Word 54 that is correctly deciphered. The participant is then awarded a score for correctly deciphering the Merge Word 54 based on the corresponding Word Score and Word Level. The score awarded may be equal to the Word Score or the Word Level. Alternatively, the score awarded to the participant may be a combination of the Word Score and the Word Level. For example, the score may be calculated by adding together the Word Score and the Word Level, or by multiplying the Word Score by the Word Level.

Figure 5:
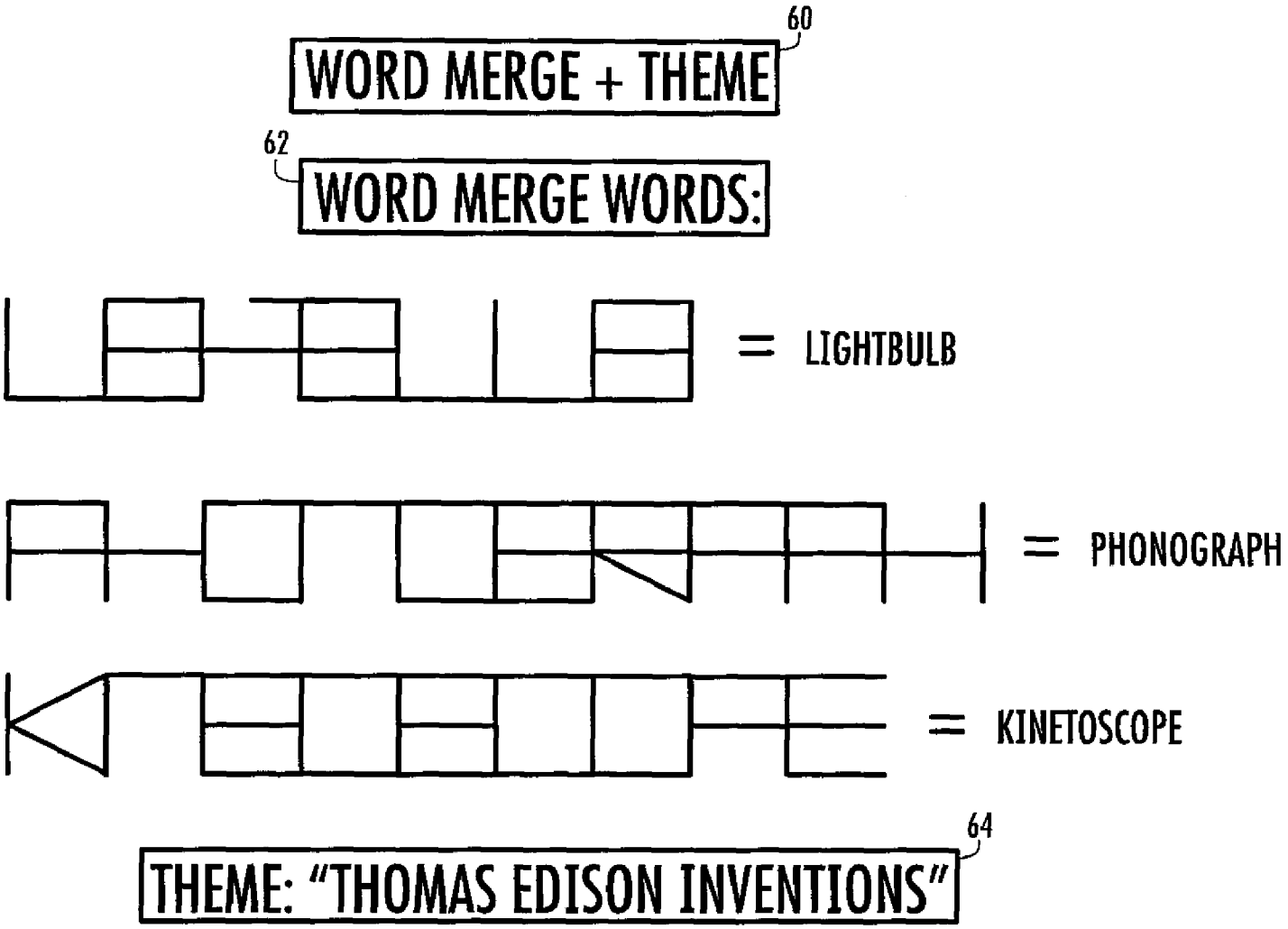
FIG. 5 illustrates a second exemplary embodiment of a word game wherein an objective is to decipher a word formed from the stylized alphabet letters of FIG. 1 that share at least one common side.

FIG. 5 illustrates a second exemplary embodiment of a word game 60 wherein an objective is to decipher a word formed from the stylized alphabet letters 10 of FIG. 1 that share at least one common side. The word game 60 illustrated in FIG. 5 is presently referred to as "Word Merge+Theme" and includes one or more Word Merge Words 62 that relate to a common theme 64. An objective of the word game 60 illustrated in FIG. 5 is for a participant to decipher the one or more Word Merge Words 62 relating to a common theme 64, that is not provided to the participant. In the example shown and described herein, the Word Merge Words 62 are LIGHTBULB, PHONOGRAPH and KINETOSCOPE. Once the Merge Words 62 are correctly deciphered, the participant suggests a theme 64 common to the deciphered Merge Words 62. As previously discussed, the Word Score and the Word Level may be determined for each Merge Word 62 that is correctly deciphered. The participant may then be awarded a score for correctly deciphering the Merge Word 62 based on the corresponding Word Score and Word Level. The score awarded may, for example, be calculated in any of the manners previously mentioned, or in any other manner. Furthermore, the participant may be awarded an additional "bonus" score for suggesting a theme 64 that is common to the Word Merge Words 62.

Figure 6:
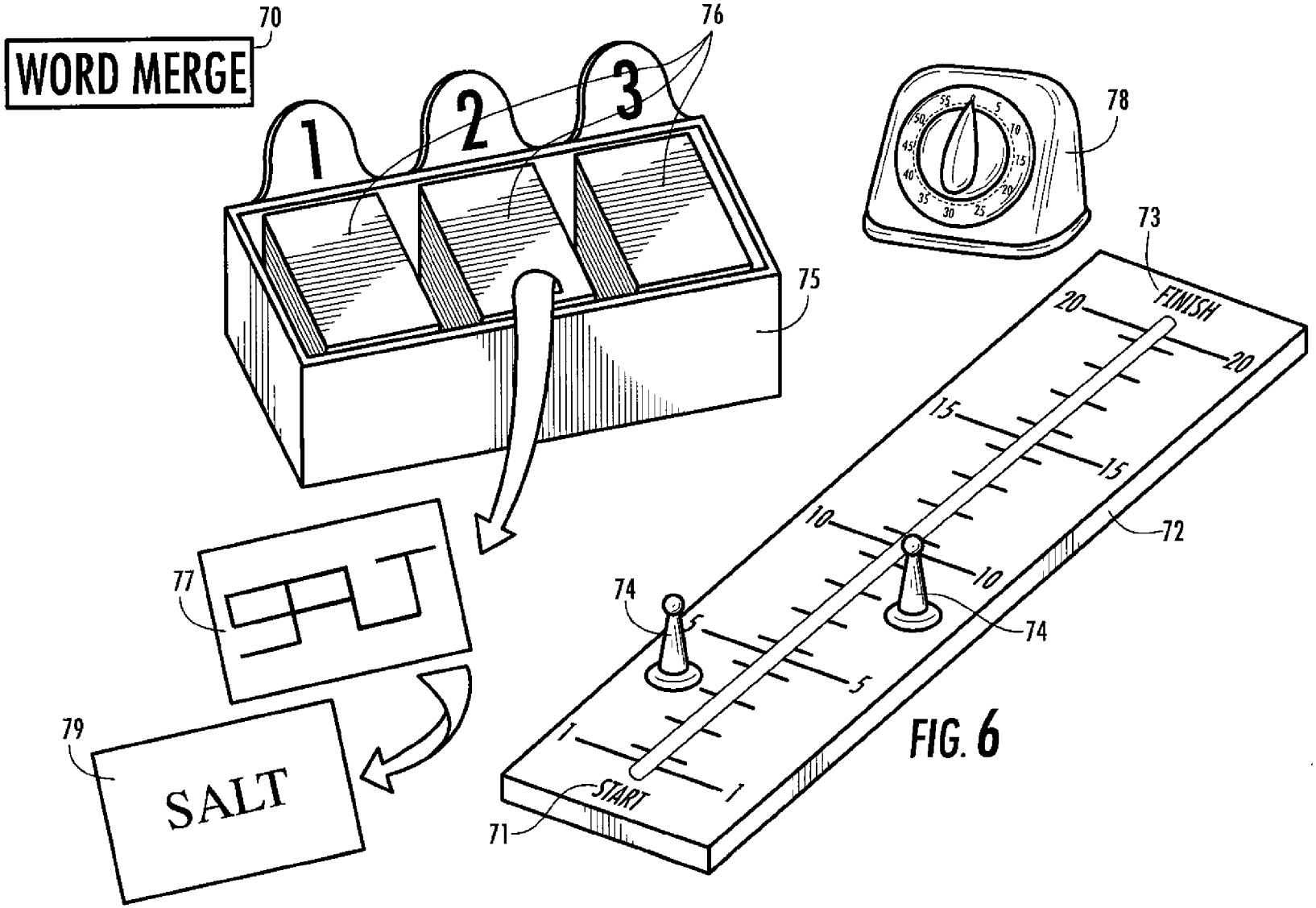
FIG. 6 illustrates a third exemplary embodiment of a word game wherein an objective is to decipher a word formed from the stylized alphabet letters of FIG. 1 that share at least one common side.

FIG. 6 illustrates a third exemplary embodiment of a word game 70 wherein an objective is to decipher a word formed from the stylized alphabet letters 10 of FIG. 1 that share at least one common side. The word game 70 illustrated in FIG.

6 is presently referred to as "Word Merge." As shown and described herein, the word game 70 known as Word Merge includes a game board 72, two or more game pieces 74, a plurality of Merge Word cards 76 and a timer 78. The game board 72 includes printed indicia for indicating at least a START position 71 and FINISH position 73 for each game piece 74. In addition, the game board 72 may include printed indicia for indicating one or more intermediate positions corresponding to a score awarded to a participant. The game pieces 74 may comprise any device suitable for marking a position on the game board 72 corresponding to the score awarded to a participant. The plurality of Merge Word cards 76 may be provided in a convenient storage container 75 that divides the Merge Word cards 76 into sections consisting of Word Merge Words 77 having a Word Level 1, Word Merge Words 77 having a Word Level 2, and Word Merge Words 77 having a Word Level 3. However, the container 75 is not required and any suitable means for dividing the Merge Word cards 76 may be employed. Alternatively, the Word Levels of the Merge Word cards 76 may be intermixed so that a participant randomly selects a Merge Word card 76 without prior knowledge of the Word Merge Word 77 or the Word Level of the Word Merge Word 77. Regardless, the correctly deciphered word 79 corresponding to the Word Merge Word 77 is provided on the reverse side of each Merge Word card 76.

The Word Merge word game 70 shown and described herein is preferably a head-to-head contest in which at least two participants, or at least two teams of participants attempt to decipher Word Merge Words 77 and advance their respective game pieces 74 along the game board 72 from the START position 71 to the FINISH position 73. In one embodiment, a first participant/team selects the Word Level (i.e. 1, 2 or 3) of a Word Merge Word 77 to be deciphered and receives a Merge Word card 76 containing a Word Merge Word 77 having the selected Word Level. The first participant/team then has a predetermined amount of time on the timer 78 to attempt to decipher the Word Merge Word 77. The predetermined time on the timer 78 may be the same for each Word Level or may be different. For example, the predetermined time for a Word Merge Word 77 having a Word Level 1 may be 15 seconds, a Word Merge Word 77 having a Word Level 2 may be 30 seconds, and a Word Merge Word 77 having a Word Level 3 may be 60 seconds. If the first participant/team correctly deciphers the Word Merge Word 77 within the predetermined time, the game piece 74 belonging to the first participant/team is moved along the game board 72 a number of spaces corresponding to the Word Level (i.e. Word Level 1=1 space, etc.). In the event the Word Merge Word 77 is not correctly deciphered, the game piece 74 is not moved. The initial round of play continues in the same manner for the second participant/team and others until all participants/teams have attempted to correctly decipher a Word Merge Word 77. The initial round of play is repeated as many times as necessary for one of the participants/teams to advance his/their game piece 74 from the START position 71 to the FINISH position 73. In an alternative embodiment, a Merge Word card 76 from one of the Word Levels is provided to all participants/teams simultaneously. The first participant team to correctly decipher the Word Merge Word 77 advances his/their game piece 74 along the game board 72 from the START position 71 towards the FINISH position 73.

The foregoing has described exemplary embodiments of a word game using stylized alphabet letters that share at least one common side. While particular exemplary embodiments of the present invention have been described, it will be apparent to those skilled in the art that various modifications thereto can be made without departing from the spirit and scope of the invention. In particular, it should be noted that a word game according to the present invention may be embodied by merely providing one or more Word Merge Words (as defined herein) in a pre-printed in a book, magazine or newspaper to be deciphered. Alternatively, a plurality of Word Merge Words may be provided to a player, participant or team on a computer, television, video screen, monitor, slot machine, etc. Furthermore, the above-described or other Word Merge word games may be adapted for television, Internet or any other visual media. Accordingly, the foregoing description of the exemplary embodiments of the invention and the best mode for practicing the invention are provided for the purpose of illustration only and not for the purpose of limitation.

That which is claimed is:

1. A word game set comprising:

a game board;

two or more game pieces;

a timer; and a plurality of game cards each displaying line segments collectively representing ordered alphabet letters horizontally arranged from left to right and together spelling a word which consists only of said line segments and within which no extra letters or line segments are present, at least some of the line segments being vertical, the letters being partially horizontally merged such that at least some of the vertical line segments of adjacent letters coincide but no vertical line segment of any one letter appears to the left of any vertical line segment of any other letter preceding the one letter in the spelling of the word, wherein each of the alphabet letters is assigned a level of difficulty corresponding to the difficulty typically required to identify the letter within a word formed from the alphabet letters.

2. A word game according to claim 1, wherein each of the words on the game cards is assigned a level of difficulty corresponding to the difficulty typically required to decipher the word.

3. A method of conducting a game according to which a participant attempts to decipher a word displayed with adjacent letters having overlapping visually indistinguishable strokes, the method comprising:

providing an electronic device;

displaying by the electronic device line segments collectively representing ordered alphabet letters horizontally arranged from left to right and together spelling a particular word within which no extra letters or line segments are present, each stroke of each letter being represented by a single one of the line segments, at least some of the line segments being vertical, wherein at least two of the letters represented by the displayed line segments are at least partially horizontally merged such that at least one vertical line segment simultaneously represents at least two respective strokes of two adjacent letters in the spelling of the word with the two strokes entirely visually overlapping and indistinguishable from each other, and wherein no vertical line segment of any one letter appears to the left of any vertical line segment of any other letter preceding the one letter in the spelling of the word;

receiving a response from a participant;

determining whether the response correctly indicates the particular word;

indicating by the electronic device whether the response was determined to correctly indicate the particular word; and calculating a score according at least to whether the response was determined to correctly indicate the particular word.

4. A method according to claim 3, wherein the alphabet letters are selected from the group consisting of majuscule English language alphabet letters in a block style font formed on a square grid using line segments.

5. A method according to claim 4, wherein a portion of the alphabet letters is assigned a first level of difficulty and another portion of the alphabet letters is assigned a second level of difficulty different than the first level of difficulty.

6. A method according to claim 5, wherein yet another portion of the alphabet letters is assigned a third level of difficulty different than the first level of difficulty and different than the second level of difficulty.

7. A method according to claim 6, wherein the first level of difficulty is assigned Letter Level 1, the second level of difficulty is assigned Letter Level 2 and the third level of difficulty is assigned Letter level 3.

8. A method according to claim 6, wherein the alphabet letters of the first level of difficulty consist of the majuscule English language alphabet letters H, K, Q, R, T, V, X and Z.

9. A method according to claim 6, wherein the alphabet letters of the second level of difficulty consist of the majuscule English language alphabet letters G, J, L, M, N, P, U, W and Y.

10. A method according to claim 6, wherein the alphabet letters of the third level of difficulty consist of the majuscule English language alphabet letters A, B, C, D, E, F, I, O and S.

11. A method according to claim 6, wherein the score is calculated by adding together the level of difficulty assigned to each of the alphabet letters used to form the word.

12. A method according to claim 3, further comprising displaying a clue that relates to the word formed by the plurality of alphabet letters.

13. A method according to claim 12, wherein the clue comprises a theme common to each of a plurality of words represented in a plurality of said displaying steps.

14. A method according to claim 3, further comprising providing a timer.

15. A method according to claim 14, wherein at least a first word is assigned a first level of difficulty and at least a second word is assigned a second level of difficulty different than the first level of difficulty.

16. A method according to claim 15, wherein at least a third word is assigned a third level of difficulty different than the first level of difficulty and different than the second level of difficulty.

17. A method according to claim 16, wherein the one of the game pieces is advanced on the game board a number of spaces equal to the level of difficulty of the word formed by the alphabet letters when that word is correctly deciphered by the participant within the predetermined time.

18. A method of conducting a game according to which a participant attempts to decipher a word displayed with adjacent letters having overlapping visually indistinguishable strokes, the method comprising:

providing a plurality of game cards;

displaying on each game card line segments collectively representing ordered alphabet letters horizontally arranged from left to right and together spelling a particular word within which no extra letters or line segments are present, each stroke of each letter being represented by a single one of the line segments, at least some of the line segments being vertical, wherein at least two of the letters represented by the displayed line segments are at least partially horizontally merged such that at least one vertical line segment simultaneously represents at least two respective strokes of two adjacent letters in the spelling of the word with the two strokes entirely visually overlapping and indistinguishable from each other, and wherein no vertical line segment of any one letter appears to the left of any vertical line segment of any other letter preceding the one letter in the spelling of the word; and receiving a response from a participant;

determining whether the response correctly indicates the particular word;

indicating whether the response was determined to correctly indicate the particular word; and calculating a score according at least to whether the response was determined to correctly indicate the particular word.

* * * * *